US006997274B2

(12) United States Patent
Metten

(10) Patent No.: US 6,997,274 B2
(45) Date of Patent: Feb. 14, 2006

(54) GOLF BAG

(76) Inventor: Ewald Metten, Schlossstrasse 151, 46535 Dinslaken (DE)

( * ) Notice: Subject to any disclaimer, the term of this patent is extended or adjusted under 35 U.S.C. 154(b) by 0 days.

(21) Appl. No.: 10/473,566

(22) PCT Filed: Mar. 27, 2002

(86) PCT No.: PCT/DE02/01106

§ 371 (c)(1),
(2), (4) Date: Sep. 29, 2003

(87) PCT Pub. No.: WO02/078796

PCT Pub. Date: Oct. 10, 2002

(65) Prior Publication Data

US 2004/0113380 A1 Jun. 17, 2004

(30) Foreign Application Priority Data

Mar. 30, 2001 (DE) ..... 101 16 052

(51) Int. Cl.
*B62B 1/12* (2006.01)

(52) U.S. Cl. ..... 180/19.1; 180/208; 280/30; 280/47.26; 280/DIG. 6

(58) Field of Classification Search ..... 180/19.1, 180/19.3, 16, 15, 20, 208; 280/DIG. 6, 30, 280/651, 47.24, 47.26, 47.35, 79.11, 79.2
See application file for complete search history.

(56) References Cited

U.S. PATENT DOCUMENTS 2,590,178 A 3/1952 Jamison
2,597,386 A 5/1952 Schmid
3,014,732 A 12/1961 Schemenauer
3,451,690 A 6/1969 Cravens (Continued)

FOREIGN PATENT DOCUMENTS

DE 3705187 1/1988

(Continued)

*Primary Examiner*—Anne Marie Boehler
(74) *Attorney, Agent, or Firm*—Collard & Roe, P.C.

(57) ABSTRACT

A golf bag that essentially comprises a ready-to-go, bag-type container with carrying handle that accommodates the clubs and at least one further insertable accessory. The clubs are disposed in recesses that are distributed across the circumference of the container, thereby forming a center cavity. The golf bag also comprises a trolley on wheels and a towing bar with a handle and an electronic control. The aim of the invention is to provide a golf bag that can be used for many purposes. To this end, the recesses for the clubs are configured as chambers subdivided by internal partitions between an inner tube and an outer tube, several chambers forming together a flap across the length of the container that can be opened or closed. The container can further be provided with a hoop that is configured as a trolley and that can be linked with wheels, an additional wheel on the bottom that can be driven by an electric motor and, on the top and bottom end, covers that are adapted to the cross-section of the container and that can be partially pulled on the bag. The container is further linked to a suitcase-type, transportable unit by means of a linkage that extends in the center thereof. The wheels are housed in the upper cover and in the lower cover and the trolley hoop the motor and the battery in the interior of the container. It is likewise possible to accommodate the entire drive unit in the interior of the container.

31 Claims, 6 Drawing Sheets

U.S. PATENT DOCUMENTS

Figure 1:
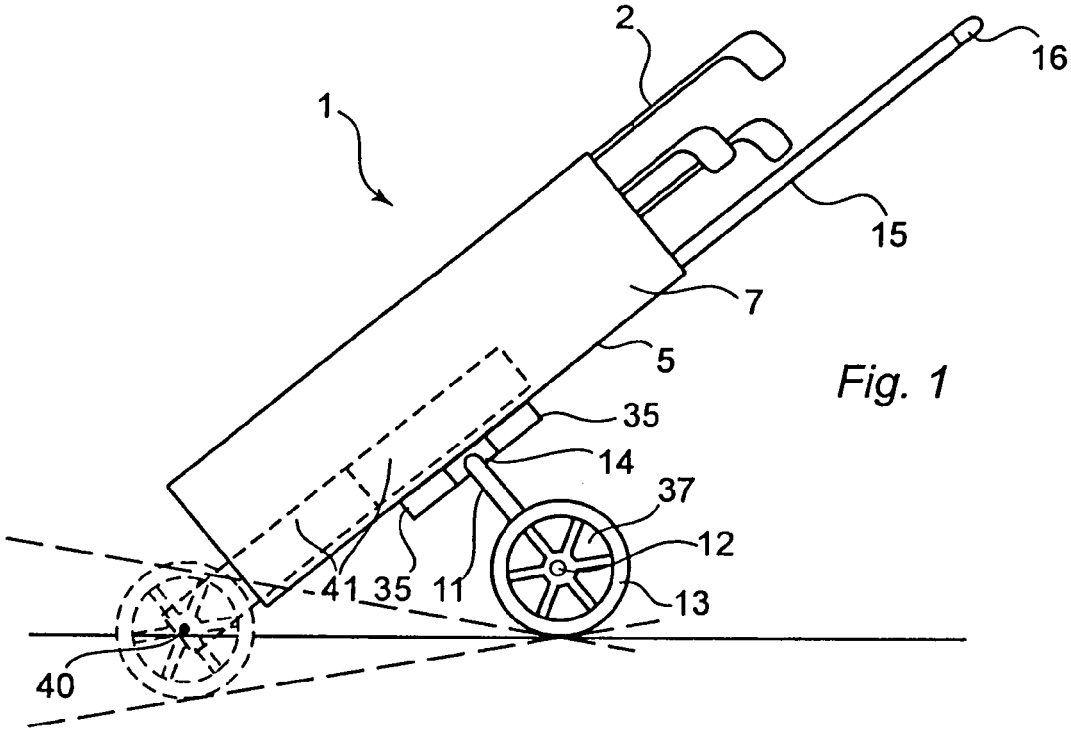

| | | | | | |
|---|---|---|---|---|---|
| 3,948,332 | A | * | 4/1976 | Tyner | 180/19.1 |
| 4,852,896 | A | * | 8/1989 | Mills | 280/47.18 |
| 5,074,576 | A | | 12/1991 | Finlay | |
| 5,839,528 | A | * | 11/1998 | Lee | 180/16 |
| 5,967,543 | A | * | 10/1999 | Taylor | 280/645 |
| 6,161,692 | A | | 12/2000 | Lizarraga | |
| 6,186,520 | B1 | * | 2/2001 | Barten | 280/30 |
| 6,186,522 | B1 | * | 2/2001 | Weis | 280/37 |

FOREIGN PATENT DOCUMENTS

| | | |
|---|---|---|
| DE | 3714066 | 2/1988 |
| DE | 29820017 | 2/1999 |
| DE | 29919158 | 1/2000 |
| FR | 2641195 | 7/1990 |
| GB | 800048 | 8/1958 |
| GB | 2134797 | 8/1984 |
| WO | WO0103779 | 1/2001 |

* cited by examiner

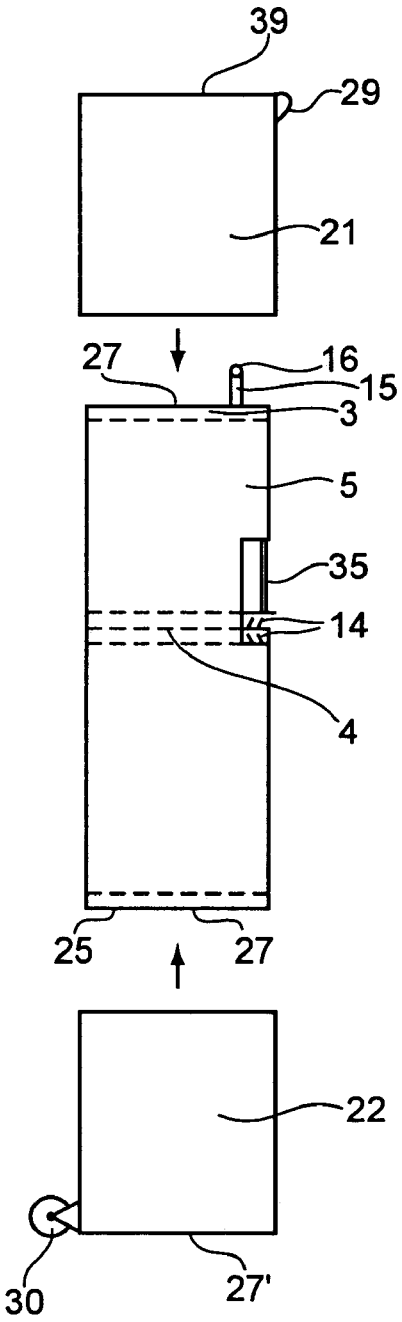
Fig. 5a
Fig. 6a
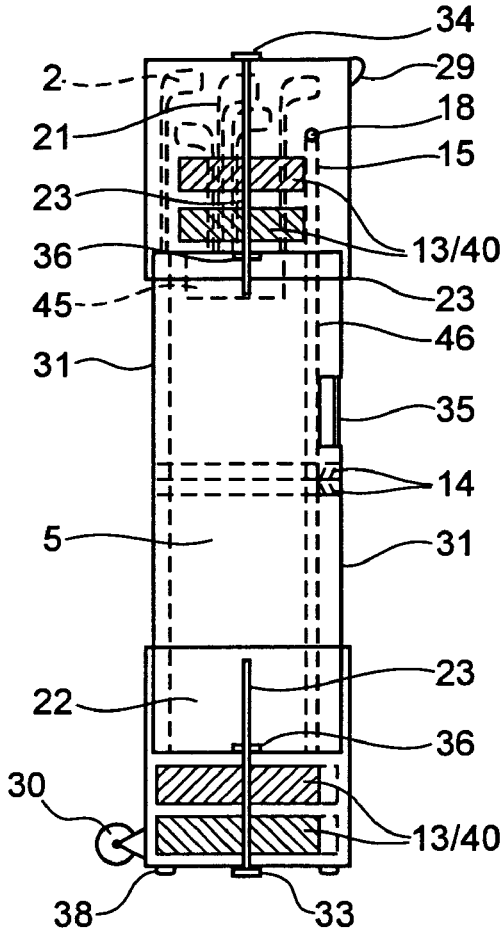
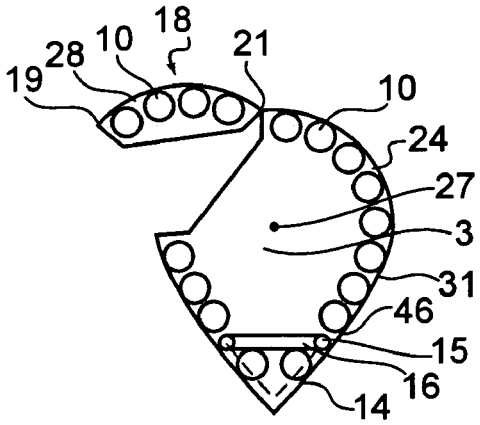
Fig. 11

GOLF BAG

CROSS REFERENCE TO RELATED APPLICATIONS

Applicants claim priority under 35 U.S.C. §119 of GERMANY Application No. 101 16 052.6 filed on Mar. 30, 2001. Applicants also claim priority under 35 U.S.C. §365 of PCT/DE02/01106 filed on Mar. 27, 2002. The international application under PCT article 21(2) was not published in English.

The invention relates to a golf bag that essentially comprises a bag-type container that accommodates the clubs and at least one further insertable accessory, in which the clubs are disposed in recesses that are distributed around the circumference, thereby forming a center cavity, and that has a trolley on wheels and a towing bar with a handle.

Golf bags are known in great numbers and in the most varied embodiments. For example, so-called standing bags are used in many instances, which have a narrow, quiver-type container for the clubs and are provided with various pockets on the outside. Furthermore, they are equipped with support legs that open up when the bag is set down, and have not only a handle but also at least one carrying strap. The disadvantage of such golf bags can essentially be seen in the fact that they must be carried, that in order to facilitate carrying, they do not have a lot of storage space, and that they experience a severe stress on the support legs, which stress can actually lead to destruction, because of the constantly repeated setting-down process.

The most common form of golf bags used on golf courses is a spacious, bag-type container that accommodates the clubs, which is provided on the outside with a number of pockets that can be opened and closed with zippers, and which can be connected with a so-called trolley, to produce a mobile, i.e. pullable unit, by simple means. A trolley or a golf cart in turn consists essentially of a chassis with wheels and a towing bar with a handle, and can be broken down into its individual parts relatively quickly, at least in various embodiments.

Furthermore, electric drives are known in various embodiments, to support the pulling or pushing process of trolleys. The wheels are coupled with a battery-driven motor.

In addition to the golf bags that can be carried or driven, as described, which are considered to be generally known, special embodiments of golf bags are also known, as they are described in the following.

DE 299 19 158 U1 shows a golf bag that accommodates golf clubs and other equipment items, having a plurality of club holder elements that are formed by segments of hollow profiles and a bag body that surrounds a storage cavity, whereby the side wall formed in this way has at least two segments, releasably connected with one another, of club holder elements rigidly connected with one another. The golf bag can be (releasably) connected with the golf cart at the side wall, with one segment.

DE 37 05 187 A1 shows a golf bag which, comprising several components, can be combined to form a suitcase-like transportable unit, whereby the wheels and the chassis hoop can be pivoted to lie flush against the container.

DE 37 14 066 C2 shows a golf cart with an electric drive unit, in which the motor and the battery are housed in the interior of the container and drive both wheels.

However, since there is an undeniable tendency in golf as a sport to not always play only on one specific home golf course, but also to play on nearby or even more remote golf courses, the transport of a golf bag represents a particular problem. During travel, the trolley that is generally used is left out, since in its entirety, it is too bulky for any transport and cannot be accommodated in a travel bag in its individual parts.

The golf bags equipped with an integrated trolley bring particular difficulties with them, particularly if they are used frequently, because of their tendency to have problems. In order to be able to accommodate a trolley, particularly on wheels, in the bag, container, or carrying body, a plurality of connecting rods, supports, and articulations is required, which do not withstand frequent stresses.

In contrast to this, the invention is based on the task of creating a golf bag in which the container that accommodates the clubs can quickly and easily be connected with a trolley to produce a pullable and electrically driven golf cart, which has a stable, self-supporting container that accommodates the clubs and accessories, with appropriate storage space, and which can be turned into a practical, easy to handle, compact, travel-capable, suitcase-type transport unit, in simple manner, including the trolley.

It is easily possible to provide the golf cart with an electric drive. For this purpose, it is necessary to provide an additional, releasable wheel at the bottom of the container, which is driven by way of an electric motor, whereby the battery and the motor can be housed in the container. Operation of the drive can take place from the handle of the towing bar, whereby the corresponding cables can be passed through the towing bar. It can furthermore be viewed as a particular advantage that the complete, mobile unit can be used alternately as an electric or manual golf trolley with a bag, during play operation, without having to be refitted.

This task is accomplished, according to the invention, in that the clubs are accommodated in chambers subdivided by means of partitions between an inner tube and an outer tube, or by a central cavity, in tubes arranged distributed over the circumference, and that several chambers, i.e. tubes form a flap across the length of the container that can be opened or closed, and that the container can be provided with a hoop that is configured as a trolley and can be linked with wheels, and with covers on the top and bottom end that can be partially pulled onto the bag and are adapted to the cross-section of the container, and can be linked, by means of a central linkage, to produce a suitcase-like, transportable unit, whereby the wheels are accommodated in the two covers and the trolley hoop is accommodated in the interior of the container.

The particular advantage can be seen in that the chambers, tubes, for example made of plastic or a light metal, which guarantee gentle handling and a constant overview of the sequence of the clubs, form a stable, self-supporting container as the basis for the entire unit. The container has a cavity over its entire length, which can be used as storage space, and which is accessible by way of a corresponding flap.

The container, formed from chambers, tubes, using the so-called sandwich construction method, is equipped with a locking device of a known construction, for releasably accommodating a trolley configured as a hoop with wheels, so that the pullable and electrically drivable golf cart can be set up in a few minutes, by affixing the trolley and pulling out and locking in place a telescope-type towing bar with handle, which is housed in chambers.

On the other hand, the golf cart can be converted into a travel-ready, suitcase-type transport unit by partially pulling on a top and a bottom cover and tightening them in place by means of a central linkage, in a few moments, whereby all of the individual parts are housed in the unit, in practical manner, and the transport unit is provided with appropriate towing bars, handles, and rollers. Within the scope of the invention, it proves to be particularly advantageous that the cross-section of the container and the covers is structured in such a way that the wheels find room on the two covers and are held immovably in their position by means of the central linkage.

The top cover protects the club heads and can be tightened in place by way of a central linkage. Within the scope of the invention, however, it is also possible to link the covers with the container by way of snaps, Velcro, or other closures, to produce a unit. In order to house the club heads of long clubs, for example woods, in gentle manner, without having to make the top cover unnecessarily large, an embodiment of the invention provides for passing the shafts of these clubs through bottom openings of the container and through openings provided between the spokes of the wheels.

In order to be able to house the hoop, which can be releasably locked in place on the container, and is configured as a trolley and equipped with axles having wheels, in the container in simple manner, the hoop is structured in two parts.

Figure 2:
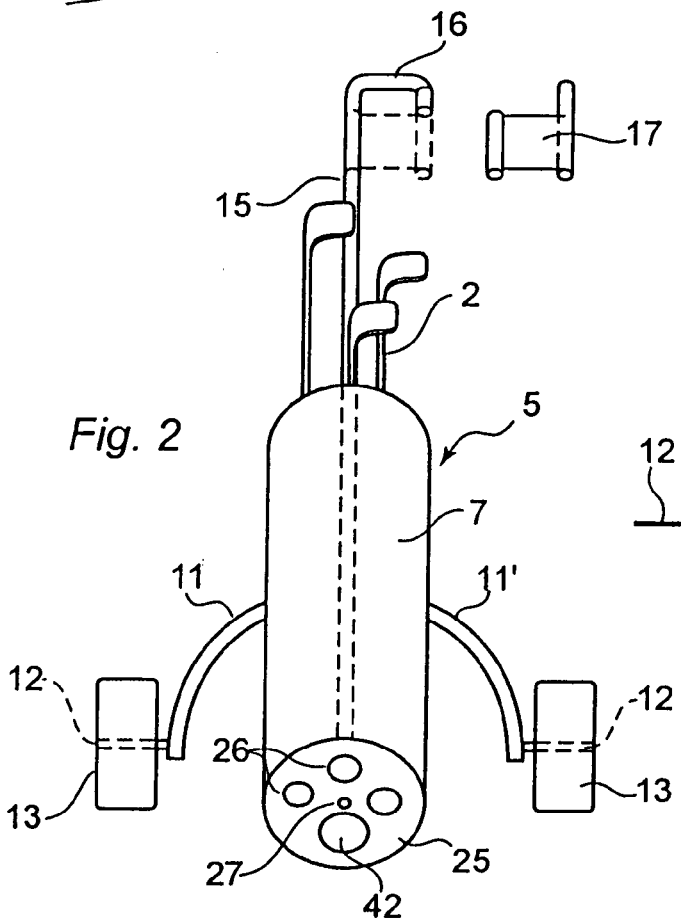
Figure 3:
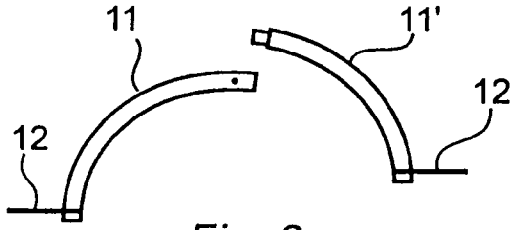
Figure 1A:
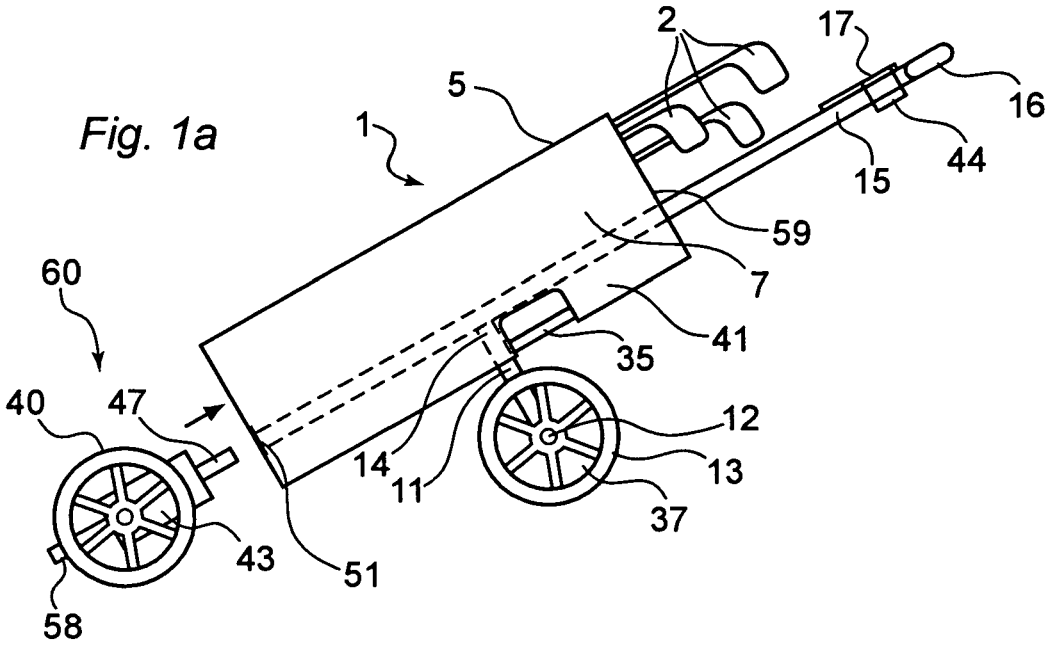
Figure 2A:
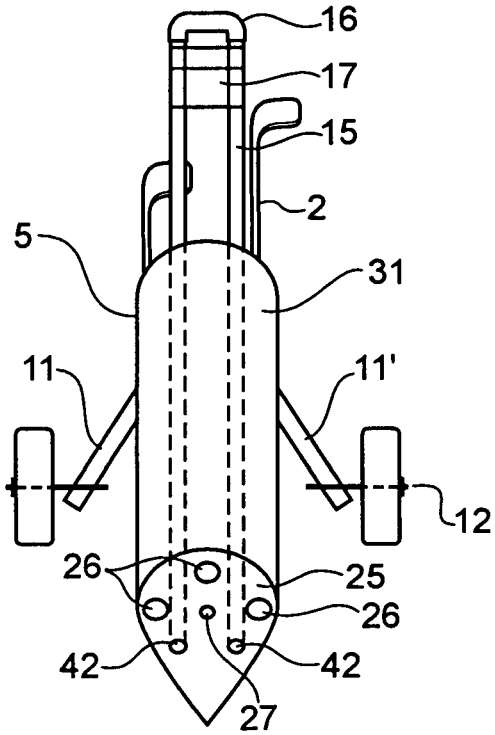
Figure 3A:
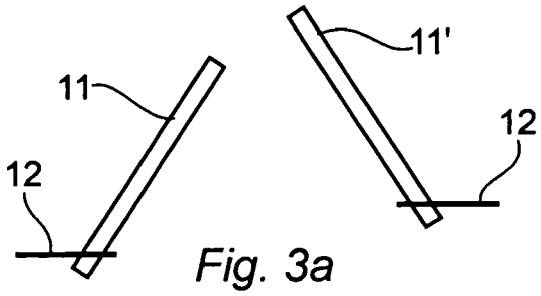
Figure 4:
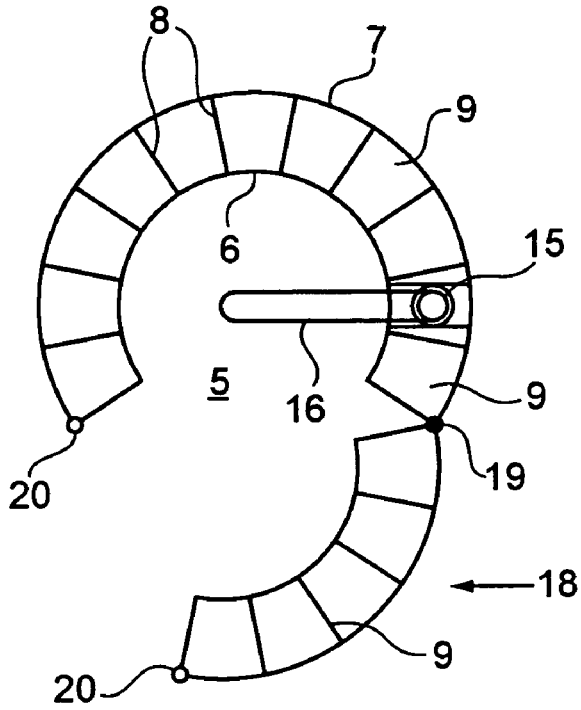
Figure 8:
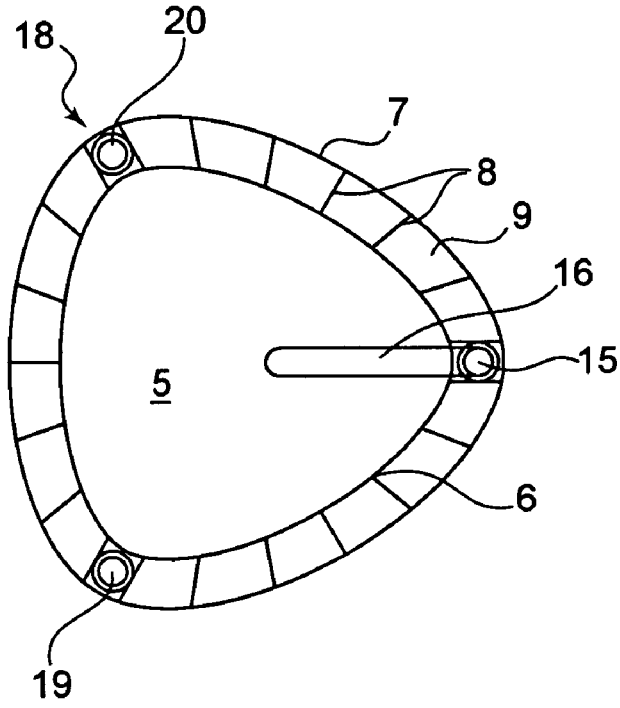
Figure 5:
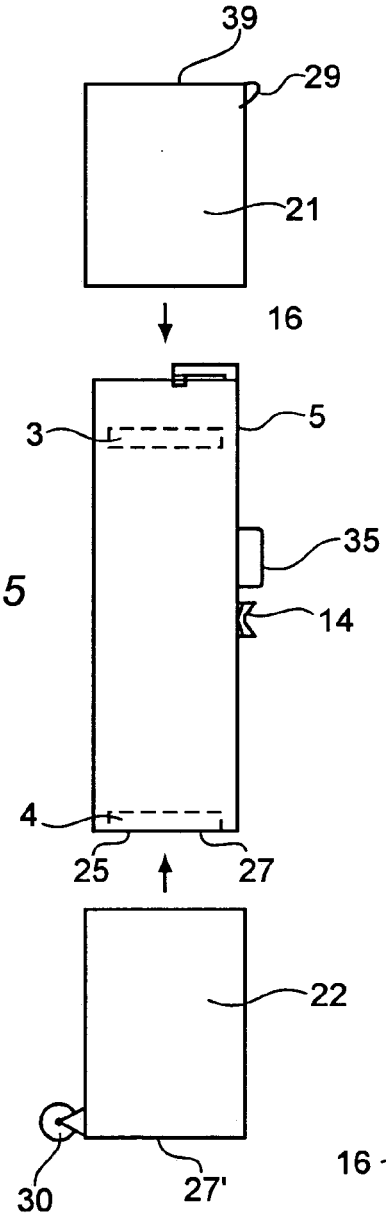
Figure 6:
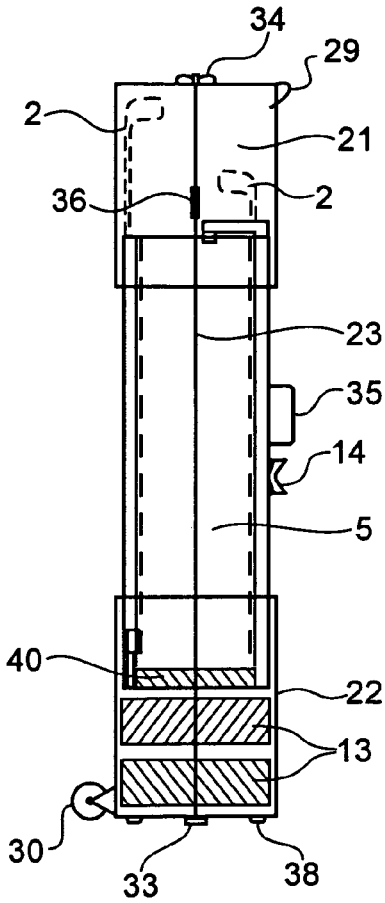
Figure 7:
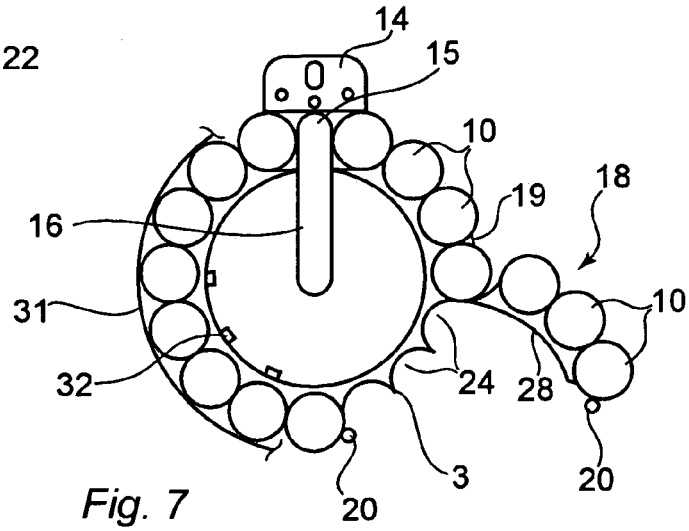
Figure 9:
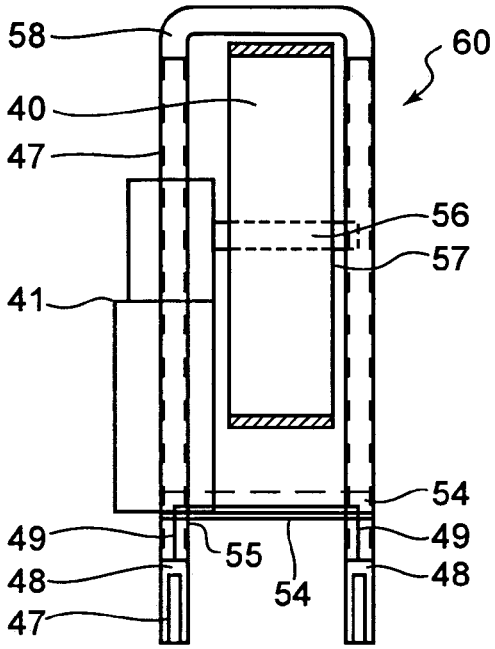
Figure 9A:
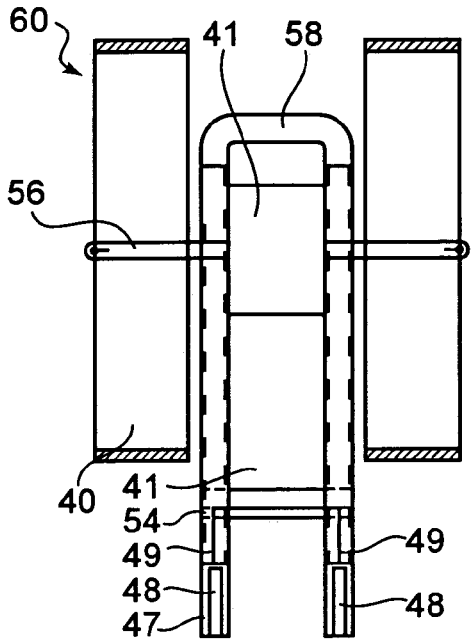
Figure 10:
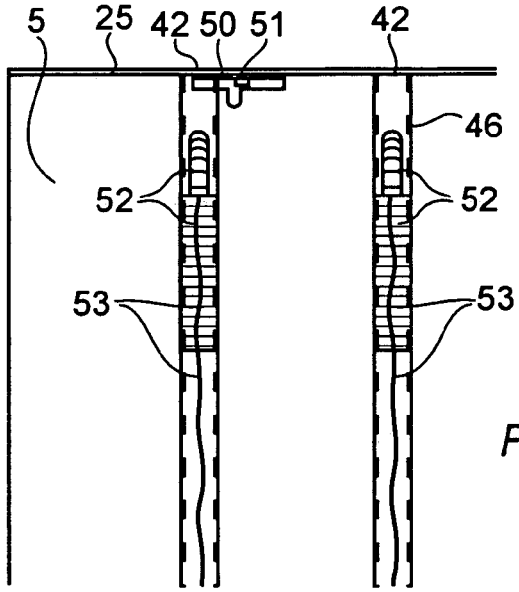

Various embodiments of the invention are shown in the drawings and will be explained in greater detail in the following. The drawings show:

FIGS. 1+1*a* a side view of a pullable golf cart,

FIGS. 2+2*a* a rear view of the golf cart shown in FIG. 1,

FIGS. 3+3*a* a view of a hoop configured as a trolley,

FIG. 4 a top view of the container, with the flap open,

FIGS. 5+5*a* a side view of the parts, which can be assembled to produce a transport unit, FIGS. 6+6*a* a side view of the assembled transport unit, partly in cross-section, FIGS. 7+8 a top view of other exemplary embodiments, FIGS. 9+9*a* a top view of the complete electric drive unit, FIG. 10 a top view of the holder tubes for the electric drive unit in the container (5), FIG. 11 a top view of another exemplary embodiment.

FIGS. 1+1*a* show a side view of a drivable or pullable golf bag 1 as an exemplary embodiment, which essentially comprises a container 5, having chambers (9) distributed over the circumference, in combination with a hoop 11 having wheels 13, as a trolley. The hoop 11, as FIG. 3 indicates in greater detail, is structured in two parts and has two hoop elements 11, 11' having corresponding axles 12 that hold the wheels 13. The hoop 11, 11' can be releasably attached to the container 5 by means of a locking device 14, which is considered to be known. The towing bar 15 is structured so that it can be pulled out in telescope manner, and locked in place in the end position by means of a rotation, and is provided with a handle 16 in this embodiment. Furthermore, a carrying handle 35 is affixed to the container 5, in such a manner that when the suitcasetype unit is being carried, it is approximately in equilibrium. The wheels 13, which can be releasably set onto the axles 12, have openings 37 between the spokes. There is an electric drive unit 60 on bag 1 as well.

In FIGS. 1+1*a* and 2+2*a*, the clubs indicated within the container 5 are indicated with the reference number 2. From the rear view according to FIG. 2, it is evident, for one thing, that a writing pad 17 that can be partly flipped open, which is required for playing golf, is arranged on the towing bar 15, i.e. the handle 16. In the bottom 25 of the container 5, a small opening 27 is provided centrally, and three larger openings 26, for example, are provided.

FIG. 4, in a top view, shows the container 5 formed by an inner tube 6 as well as an outer tube 7, with partitions 8, for accommodating clubs 2 and another insertable accessory. The container 5, which has a circular cross-section, for example, is provided with a flap 18, over its length, which can be flipped open and closed by way of at least one hinge 19, for example located in the interior, and can be locked by way of a corresponding locking mechanism 20, for example also located in the interior. The flap 18 is formed by several chambers 9.

In the side view according to FIGS. 5+5*a*, the essential parts, specifically the container 5 and the covers 21 and 22, are shown in the non-assembled state. The top cover 21 has a rope handle, which can be recessed, for example, as the towing handle 29, using which the suitcase-type unit according to FIG. 6 can be pulled by hand. In this connection, the rollers 30 provided on the bottom cover 22, arranged at a distance from one another, are of significance. Furthermore, openings 27, 27' and 39 to hold the linkage 23 are provided in the two covers 21 and 22 as well as in the bottom 25 of the container 5.

In FIGS. 6+6*a*, the essential individual parts 5, 21, and 22 are linked with one another by means of a centrally arranged linkage 23, to form a suitcase-type, transportable unit. According to another exemplary embodiment, not shown in the drawings, another form of linking the covers 21, 22 with the container 5 could also be provided. For example, the covers 21, 22 could have an inside bead that could guarantee that they are pulled over to the desired length. Furthermore, the covers 21, 22 could then be connected with the container 5 by way of other closures, such as closures in the form of snaps or Velcro, for example.

FIG. 7 shows a top view of the container 5, in an embodiment in which the clubs 2 are accommodated in the form of tubes 10 arranged over the circumference of the container 5. To achieve sufficient stability and inherent support of the container 5, the latter has a frame 3 and 4 above and below. The exemplary embodiment shows a circular cross-section, whereby the circular frames 3 and 4 have semi-circular recesses 24, in each instance, in order to be able to arrange the tubes 10 next to one another. At the bottom of the container 5, a base plate 25 is provided. Furthermore, in FIG. 7, an optional mantling 31 made of plastic, a light metal, or another material is indicated, which is possible for every embodiment. The mantling can have any desired surface, for example a textured surface. The flap 18, in which several tubes 10 are brought together by way of hoops 28, is structured so that it can be flipped open and closed by way of hinges 19, and locked by way of a locking mechanism 20. The top view according to FIG. 7 also shows the arrangement of the link 14 required for the trolley. In order to house the required golf equipment within the container 5, suspension devices 32 can be arranged within the container, in addition to the intermediate bottoms, on which bags or pockets can be suspended.

FIGS. 9+9*a* show the entire electric drive unit 60 which can be inserted into the holder tubes 48, according to FIG. 10, with the guide tubes 47, and attached in the interior of the container 5 with the latch 51. In the interior of the guide tube 47, there are the couplings 48 and the cable 49. The coupling 48 is connected with the plug 52 according to FIG. 10 by pushing them together. The gear motor 43 is attached between, next to, or under the guide tubes 47. The contact bracket 54 ensures the final position during insertion into the holder tube 46 through the opening 42, and a firm seat of the unit on the container 5. As an end part, the handle/bumper 58 contributes to stability and better operability.

FIG. 10 shows the holder tubes 46 with the plug 52, cable 53, as well as latch 51, which, by means of the openings 50, assures attachment of the electric drive unit by means of the openings 42 in the bottom 25 of the partially depicted container 5.

FIG. 11, in contrast to FIG. 7, shows a circular cross-section that comes to a point, and circular recesses 24. The telescoping bar is passed through two tubes.

REFERENCE SYMBOL LIST

1 golf bag
2 club(s)
3 upper bottom
4 lower bottom
5 container
6 inner tube
7 outer tube
8 partitions
9 chamber
10 tube
11 11' hoop
12 wheel axle
13 wheels
14 locking mechanism (hoop)
15 towing bar
16 handle
17 writing pad
18 flap
19 hinge
20 locking mechanism
21 cover
22 cover
23 linkage
24 recess
25 base plate
26 openings (clubs)
27 27' central bore
28 hoop (flap)
29 towing handle (top cover)
30 rollers (bottom cover)
31 mantling
32 suspension devices (inside)
33 linkage head
34 wing nut
35 carrying handle (suitcase)
36 cuff
37 spoke openings
38 standing feet
39 opening
40 wheels for drive
41 battery
42 openings for electric drive
43 gear motor
44 electric control
45 housing
46 holder tube
47 guide tube (motor unit)
48 electric coupling
49 cable
50 openings (holder tube)
51 latch
52 plug
53 cable
54 contact bracket
55 openings (guide tube)
56 motor shaft
57 shaft bearing
58 handle/bumper
59 locking mechanism
60 Electric Drive Unit

What is claimed is:

1. A golf bag comprising:

a container that accommodates golf clubs and at least one insertable accessory, said container having recesses for the clubs, said recesses being distributed around a circumference of the container and thereby forming a center cavity of the container, wherein the recesses are configured as chambers subdivided by partitions between an inner tube and an outer tube, wherein several chambers as a unit form a flap that is openable and closable over a length of the container;

a towing bar with a handle attached to the container;

a hoop forming a trolley, said trolley having wheels and an additional wheel at a bottom portion;

an electric motor for driving the trolley;

covers on the top and bottom end of the bag, said covers adapted to be partially pulled onto the bag and being adapted to the cross-section of the container; and a cental linkage that links said covers to produce a transportable unit;

wherein the wheels are accommodated in the bottom cover, and the trolley, motor, and battery are accommodated in an interior of the container.

2. Golf bag according to claim 1, wherein there are several chambers configured as a unit, said unit adapted to be flipped open and closed relative to the rest of the container via hinges, and further comprising a locking mechanism for locking the unit.

3. Golf bag according to claim 1, wherein the container has a circular cross-section.

4. Golf bag according to claim 1, wherein the top cover has a handle in the form of a recessed towing rope.

5. Golf bag according to claim 1, wherein the bottom cover has two rollers arranged at a distance from one another.

6. Golf bag according to claim 1, wherein the container, partitions and covers are made of plastic or a light metal or a combination of these materials.

7. Golf bag according to claim 1, wherein the interior of the container has suspension devices for holding accessories.

8. Golf bag according to claim 1, wherein the linkage is passed centrally through the container and has a screw connection below the bottom cover and above the top cover.

9. Golf bag according to claim 1, wherein the linkage is passed centrally through the container and is divided into two parts and is braced by a cuff and a thread.

10. Golf bag according to claim 1, wherein the hoop is configured in two parts and wherein the wheels are releasable.

11. Golf bag according to claim 1, further comprising an additional carrying handle on the container.

12. Golf bag according to claim 1, further comprising closable openings in the bottom of the container, which correspond with openings between spokes of the wheels, said closeable openings allowing long clubs to be accommodated in the golf bag.

13. A golf bag comprising:

a container that accommodates golf clubs and at least one further insertable accessory, said container having recesses for the clubs, said recesses being configured as tubes distributed around a circumference of the container, and forming a center cavity in the container;

a towing bar with a handle, said towing bar being connected to the container;

a hoop configured as a trolley, said hoop being connected to wheels and an additional wheel at the bottom of the container;

an electric motor with a battery for driving the golf bag;

covers for the container on top and bottom ends, said covers adapted to be partially pulled onto the bag and adapted to the cross-section of the container, wherein said covers are adapted to be linked by central linkage produce a transportable unit, wherein the wheels are accommodated in the bottom cover and the hoop, motor, and battery are accommodated in an interior of the container.

14. A golf bag according to claim 13, wherein the tubes are linked with a top and a bottom frame, the frames being provided on an outside with semi-circular recesses to hold the tubes.

15. A golf bag according to claim 13, further comprising an additional hoop linking several tubes to form a unit, said tubes having hinges that flip the tubes open and closed, wherein said tubes are linked with the container by way of a locking mechanism.

16. Golf bag according to claim 13, wherein the towing bar is adapted to be pushed into and pulled out of one of the tubes in a telescoping manner, as well as locked in position by means of rotation.

17. A golf bag according to claim 13, wherein the container has a mantling on an outside thereof.

18. A golf bag comprising:

a container that accommodates golf clubs and at least one further insertable accessory, said container having recesses for receiving the clubs, said recesses being configured as tubes, and distributed around a circumference of the container to form a center cavity in the container;

a towing bar with a handle connected to the container;

a hoop configured as a trolley, said hoop being connected to wheels and having an additional wheel at a bottom thereof;

an electric motor with a battery, for driving the golf bag; and covers on a top and bottom end of the container, said covers adapted to be partially pulled onto the bag and adapted to the cross-section of the container, said covers being linked by a central linkage, to produce a transportable unit, wherein the wheels are accommodated in the top cover, and the hoop, motor, and battery are accommodated in an interior of the container.

19. A golf bag according to claim 18, wherein the container has a circular cross-section that comes to a point.

20. A golf bag according to claim 18, wherein the tubes are linked with a top and a bottom frame, and wherein the frames have circular recesses on an outside thereof to accommodate the tubes.

21. A golf bag according to claim 18, wherein the towing bar is adapted to be pushed into and pulled out of one of the tubes in a telescoping manner, as well as locked in position, and wherein the towing bar has an electrical control.

22. A golf bag according to claim 18, further comprising a protective sheath releasably fastened onto the container.

23. A golf bag according to claim 18, further comprising couplings accommodated in a guide tube for connecting the electric motor.

24. Golf bag according to claim 21, wherein the couplings comprise a latch that is adapted to be pushed in and out through an opening in the container and an opening in the guide tube.

25. Golf bag according to claim 21, further comprising a cable that produces a connection to the control.

26. Golf bag according to claim 21, wherein the control is accommodated on the towing bar.

27. Golf bag according to claim 24, wherein the battery is connected with the control by the cable.

28. Golf bag according to claim 22, further comprising a housing connected to the container, said housing made of plastic and adapted to accommodate accessories.

29. Golf bag according to claim 18, wherein the motor is accommodated between two of the tubes.

30. Golf bag according to claim 28, further comprising two drive wheels accommodated outside of the tubes, on a drive shaft that passes through said tubes.

31. Golf bag according to claim 18, further comprising a shifting device in an interior of the container, said shifting device causing the battery to undergo a weight shift for the purpose of transport.

* * * * *